US009273494B2

(12) United States Patent
Fontana et al.

(10) Patent No.: US 9,273,494 B2
(45) Date of Patent: Mar. 1, 2016

(54) FASTENING AND UNFASTENING SYSTEM OF STACKABLE ELEMENTS

(76) Inventors: Fabio Fontana, Rome (IT); Massimo Fontana, Guidonia Montecelio (IT)

( * ) Notice: Subject to any disclaimer, the term of this patent is extended or adjusted under 35 U.S.C. 154(b) by 134 days.

(21) Appl. No.: 14/126,824

(22) PCT Filed: Jun. 11, 2012

(86) PCT No.: PCT/IT2012/000175

§ 371 (c)(1),
(2), (4) Date: Mar. 24, 2014

(87) PCT Pub. No.: WO2012/172583

PCT Pub. Date: Dec. 20, 2012

(65) Prior Publication Data

US 2014/0202221 A1 Jul. 24, 2014

(30) Foreign Application Priority Data

Jun. 14, 2011 (IT) ..... RM2011A0299

(51) Int. Cl.
*E05B 47/00* (2006.01)

(52) U.S. Cl.
CPC ..... *E05B 47/0038* (2013.01); *E05B 47/0044* (2013.01); *Y10T 70/7057* (2015.04)

(58) Field of Classification Search
CPC .. E05B 47/00; E05B 47/0038; Y10T 70/7057
USPC ..... 70/276, 413
See application file for complete search history.

(56) References Cited

U.S. PATENT DOCUMENTS 3,552,159 A * 1/1971 Craig ..... E05B 47/0038 70/276
3,602,020 A * 8/1971 Kajita ..... 70/276
(Continued)

*Primary Examiner* — Suzanne Barrett

(74) *Attorney, Agent, or Firm* — Hedman & Costigan, P.C.; James V. Costigan; Kathleen A. Costigan

(57) ABSTRACT

The present invention relates to a fastening or unfastening system (1, 10) including: an actuating device (2, 20), which has a plurality of actuating elements (22, 220) made of magnetic, magneto-sensitive or magnetically inert material; and a device to unlock or lock (3, 30, 3'), which includes a first element (4, 40, 4'), a second element (5, 50, 5') and a first plane (7, 70), between said first element (4, 40, 4') and said second element (5, 50), and a second plane (8, 80=between the second element (5, 50, 5') and the third element (6, 60, 6'). Said first element (40, 4, 4') and said second element (5, 5' 50) present a plurality of housing couples (41, 51, 410, 510) corresponding to said plurality of actuating elements (22, 220) of said actuating device (2, 20), provided with centering means (9, 90) said centering means (9, 90) being made of magnetic, magneto-sensitive or magnetically inert material, able to lock or unlock the movement in respect to said first plane (7, 70).

Said device (3, 30, 3') has a single housing (400, 4000) comprised of a first further housing (42, 420), a second further housing (52, 520) and a third further housing (62, 620), respectively obtained in said first, second and third elements. Said single housing (400, 4000) provides, inside, at least at least two prevent and release means (91, 92, 910, 920) each sliding mutually, and a thrust element (63, 630) acting on said prevent and release means (91, 92, 910, 920). Further, said system (1, 10) can take a first configuration, wherein said prevent and release means (91, 92, 910, 920), block the movement of said elements (4, 40, 4', 5, 50, 5', 6, 60, 6') in respect to said planes (7, 70, 8, 80), and a second configuration wherein said prevent and release means (91, 92, 910, 920) and said thrust element (63, 630), in a compressed form, allow the movement of said first (4, 40, 4') and second (5, 50, 5') element in respect to said planes (7, 70, 8, 80).

Finally, coupling and movement of actuation device (2, 20) allows the movement from said first to said second configuration.

22 Claims, 8 Drawing Sheets

(56) References Cited

U.S. PATENT DOCUMENTS

| | | | | | |
|---|---|---|---|---|---|
| 3,782,147 | A * | 1/1974 | Hallmann | 70/276 |
| 3,837,195 | A * | 9/1974 | Pelto | 70/276 |
| 3,955,388 | A * | 5/1976 | Stackhouse | 70/411 |
| 3,967,480 | A * | 7/1976 | Stackhouse | 70/276 |
| 3,978,698 | A * | 9/1976 | Ono | 70/165 |
| 4,022,038 | A * | 5/1977 | Miller | 70/276 |
| 4,380,162 | A * | 4/1983 | Woolfson | 70/276 |
| 5,819,569 | A * | 10/1998 | Herdman | 70/420 |
| 5,957,453 | A * | 9/1999 | Binkley | 273/153 S |
| 6,883,357 | B1 * | 4/2005 | Cheng | 70/432 |
| 7,621,161 | B2 * | 11/2009 | Fontana et al. | 70/276 |
| 8,608,502 | B2 * | 12/2013 | Witter et al. | 439/335 |
| 8,800,332 | B2 * | 8/2014 | Oliana | 70/276 |
| 9,010,161 | B2 * | 4/2015 | Oliana | 70/276 |
| 9,062,695 | B2 * | 6/2015 | Witter et al. | |
| 2007/0113605 | A1 * | 5/2007 | Lopez | 70/276 |
| 2008/0190152 | A1 * | 8/2008 | Fontana et al. | 70/276 |
| 2011/0121145 | A1 * | 5/2011 | Mihajlovic | 248/188 |
| 2014/0202221 | A1 * | 7/2014 | Fontana et al. | 70/276 |
| 2015/0027177 | A1 * | 1/2015 | Kessler et al. | 70/276 |

* cited by examiner

FASTENING AND UNFASTENING SYSTEM OF STACKABLE ELEMENTS

The present invention relates to a fastening and unfastening system of stackable elements.

The specification will be in the following specifically addressed to the locks sector, directly applied to a lock or as a protection of the same, but it is well evident that this application must not be considered limited to the use in this specific sector.

Innovative protection systems for locks or simply lock systems operating employing magnets having different polarity are presently available.

Said technology is widely described in Italian patent applications RM2012A000212 and RM2010A000213 of the same applicants.

Said patent applications describe a fastening and unfastening system of stackable elements, comprising a first element, a second element, to be fastened and unfastened, stacked one on top of the other along a first relative movement plane, and an actuation device. In the above system, first element and second element provides each one a plurality of housings, in a number corresponding, and reciprocally positioned in order to create housing couples, within which a centering means is provided. Further, said system provides a plurality of first magnetic elements having a first length, a plurality of second magnetic elements having a second length, lower than the length of said plurality of first magnetic elements, and a plurality of third magnetic elements, having a third length corresponding to the half of the sum of said first and second lengths, total height of the couple of housings being equal to or bigger than the double of the first length.

Still, a couple of magnetic elements is provided within each one of the housing couples, said couple being comprised of one of said first and second magnetic elements or of a couple of third magnetic elements, randomly combined both as far as their position each other and their orientation and polarity are concerned, so that their abutting ends are in correspondence of, or offset with respect to the plane.

Said operation device provides a plurality of interference elements, made up of magnetic material, or of magneto-sensitive material or of magnetically inert material, oriented and combined in such a way to attract, reject or leaving as such said couple of magnets, so that, approaching the operation element to one of the two elements, couple of magnets are all aligned along the plane, thus permitting movement each other of the two elements.

A problem of the above solution is due to the risk that, after having approached operation device to the element to fastened or unfastened, by the movement of the first or second element, magnetic centering means of couples within different housings provided within the device can contact each other, even if positioned along different orbits or different lines. In this case, device would block, thus being no more usable.

Thus, it is object of the present invention that of preventing that magnetic centering means of different positions of a fastening or unfastening device contact each other.

Further object of the present invention is that of making it easier the fastening and unfastening movement of said system within a reduced space.

It is subject matter of the present invention a fastening or unfastening system including: an actuating device, which has a plurality of actuating elements made of magnetic, magneto-sensitive or magnetically inert material; and a device to unlock or lock, which includes a first element, a second element and a first plane, between said first element and said second element; said first element and said second element presenting a plurality of housing couples corresponding to said plurality of actuating elements of said actuating device; said plurality of housing couples being aligned with the ends matching along said first plane; in each of said housing couples centering means are provided, able to lock or unlock the movement in respect to said first plane of said first element and said second element; said centering means being made of magnetic, magneto-sensitive or magnetically inert material; said system being characterized in that said device to lock or unlock, further includes at least one third element and a second plane, between said second element and said third element; and in that said first element has a first further housing, said second element has a second further housing and said third element has a third further housing, said first, second and third further housings being aligned with the ends matching, in order to form a single housing, and in that said single housing provides, internally, at least two prevent and release means each sliding mutually, and a thrust element acting on said prevent and release means, and in that said system can take a first configuration, wherein said prevent and release means, block the movement of said elements in respect to said planes, and a second configuration wherein said prevent and release means and said thrust element, in a compressed form, allow the movement of said first and second element in respect to said planes, and in that the coupling and the movement of said actuating device allows the movement from said first to said second configuration.

According to the invention, said prevent and release means can include a first prevent and release means and a second prevent and release means.

Still according to the invention, during said first configuration, said first prevent and release means can be fully housed between said first further housing and said second further housing and said second prevent and release means can be housed between said second further housing and said third further housing.

Always according to the invention during said second configuration, said first prevent and release means can be housed entirely in said second further housing and said second prevent and release means can be housed entirely in said third further housing. Furthermore, according to the invention said first prevent and release means and said second prevent and release means can be a sphere.

Further, according to the invention, said first further housing has a substantially trapezoidal cross-section with rounded corners and having the long side toward said second element, and said second further housing can have a cylindrical hollow shape.

Still according to the invention said third further housing can have a first portion, in correspondence to said second plane, having a cylindrical hollow shape and a second portion, having a smaller diameter, with an open end in correspondence to said first portion.

According to the invention, said thrust element is housed in said second portion of said third further housing.

Always according to the invention, a recess can be provided on the outer surface of said third element, so that it engages with said first prevent and release means.

Furthermore according to the invention said system can comprise further prevent and release means inserted, in correspondence to said plane between a fourth further housing obtained from said second element and between a rail obtained on the surface of said first element, or vice versa.

Still according to the invention said first element can be movable and said third element can be fixed.

Further, according to the invention, said actuating device can have a relief, and said first element and said second element can have, respectively, a first hole and a second hole, and said relief of said actuating device engages with said first hole of said first element.

Always according to the invention, said third element has a third hole for a lock, in a different position in respect to said first hole and said second hole.

Still according to the invention, said first element can be fixed and said third element can be movable.

Furthermore, according to the invention, said actuating device can have a relief, and said third element and said second element have, respectively, a further third hole and a second hole, and said relief of said actuating device engages with said further third hole of said third element.

Always according to the invention said first element can have a further first hole for a lock, in a different position in respect to said further third hole and said second hole.

Further according to the invention, said single housing is arranged in a substantially horizontal position in respect to the central axis of said device to lock or unlock, or it can be placed in a substantially vertical position in respect to the central axis of said device to lock or unlock.

Still according to the invention, said third element has at least a fifth further housing, arranged crosswise to the movement direction of said device to lock or unlock.

Finally, according to the invention, each of said fifth further housing can include a further thrust element and a further second prevent and release means.

The invention will be now described for illustrative but not limitative purposes with particular reference to the figures of the enclosed drawings, wherein.

Figure 1:
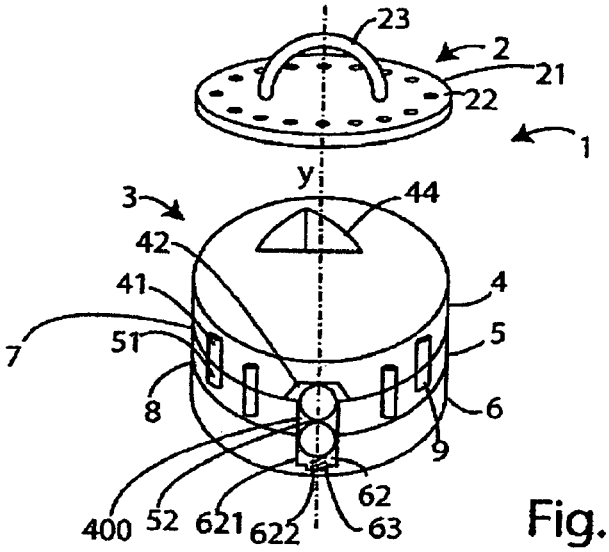
FIG. 1 is a perspective view of a first embodiment of the fastening and unfastening system according to the invention.
Figure 2:
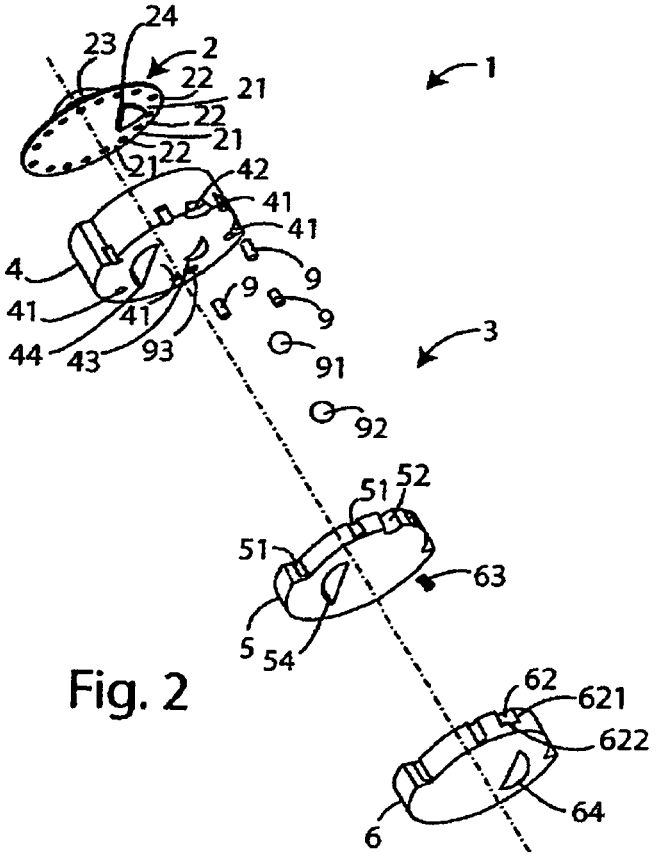
FIG. 2 is an exploded perspective view of the system of FIG. 1.

Making reference to FIGS. 1 and 2, it is observed a first embodiment of a fastening and unfastening system 1 according to the invention, having a circular shape and making a rotator movement.

Said system 1 provides an actuating device 2 and a locking and unlocking device 3.

Actuating device 2 has a circular shape, with a plurality of cylindrical housings 21, all placed along a circle, equidistant with respect to the same device. A cylindrical actuation element 22 is provided within each housing 21. Said actuation elements 22 can be comprised of magnetic material, of magnetic sensitive material or of magnetically inert material.

A grasping element 23 is provided on upper surface of actuation device 2, in this case a metallic hook, easing the use of the actuation device 2. Said grasping element 23 can be further rotated so as to close on the flat surface of the actuation device 2.

A relief 24 is obtained on the lower surface of the actuation device 2. Said relief 24 has a triangular shape, with rounded corners, but in other embodiments it can have a different geometrical shape.

Device 3 to be released and unreleased, with a circular shape, substantially with the same dimensions of the actuation device 2, provides a first element 4, a second element 5 and a third element 6.

A first relative movement plane 7 is provided between first element 4 and second element 5, and a second relative movement plane 8 is provided between second element 5 and third element 6.

Second element 5 rotates with respect to the first plane 7 and with respect to second plane 8.

In the present embodiment, first element too is movable with respect to first plane 7, while third element 6 is fixed.

In further embodiments (not shown), it is possible making first element 4 fixed with respect to first plane 7, and third element 6 movable with respect to second plane 8, always remaining within the scope of the invention, and obtaining the same technical effect.

First element 4 and second element 5 respectively have a first hole 44 and a second hole 54, said holes having substantially the same shape, dimension and position of the relief 24 of actuation device 2, in this case a triangle with rounded corners. Third element 6 has a third hole 64 for locks, substantially having the same shape and dimension of holes 44, 54 described in the above, but offset of 180° with respect to them.

Furthermore, first element 4 and second element 5 provide a plurality of couples of cylindrical housing 41, 51, having the same shape and dimension each other, and in number equal to the plurality of actuation elements 22 provided on actuation device 2. A centering means 9 is provided within each couple of housings 41, 51. Housing couples 41, 51 re aligned with corresponding ends along plane 7.

In the embodiment shown, centering means is comprised of a couple of cylindrical elements, made up of magnetic material or of magnetic-sensitive material or of magnetically inert material, two of them having the same section but different length. In further embodiments, it is possible having a different number of cylindrical elements.

At least a housing 400 is provided between said first 4, second 5 and third 6 elements. More particularly, said housing 400 is comprised of correspondence between a first housing 42 of first element 4 and a second housing 52 of second element 5 and a third housing 62 of third element 6. First housing 42 of first element 4 has a substantially trapezoidal section, with rounded corners and with long side faced toward said second element 5, while second housing 52 of second element 5 is obtained all along volume, having a tridimensional hollow shape with dimensions reduced with respect to the first housing 42, and third housing 62 of third element 6 has a first portion 621, in correspondence of second plane 8, having a hollow cylindrical shape and a second lower portion 622, having a slightly reduced cylindrical shape, with upper part open in correspondence of the first portion 621. An elastic element 63, particularly a spring, is housed within second portion 622 of third housing 62.

A first 91 and a second 92 prevent and release means are provided within housing 400, in this case having a spherical shape and base diameter substantially equal to the diameter of the second housing 52, with said first prevent and release means 91 provided above the second prevent and release means 92. Dimensions of the first further housing 42 are such to prevent an immediate and direct contact with surface of first prevent and release means 91. Said prevent and release means 91, 92 prevent, when at rest, movement of first 4 and second 5 elements with respect to planes 7 and 8.

Making reference to FIGS. 3A, 3B, 3C, 3D and 3E, it is observed operation of fastening and unfastening system 1 according to the invention.

Figure 3B:
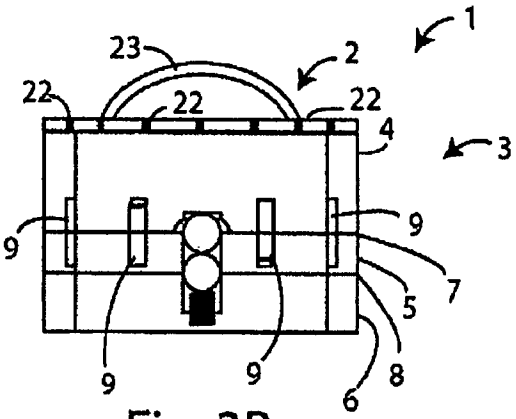
FIGS. 3A, 3B, 3C, 3D and 3E show section front views of the system of FIG. 1.
Figure 3A:
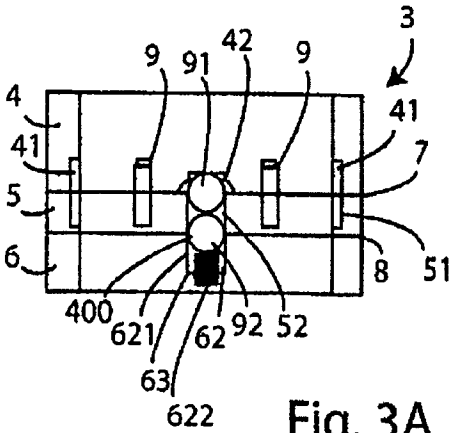

Fastening and unfastening phases of actuation device 2 with device 3 to be fastened or unfastened will be described in the following:

a. device 3 to be fastened or unfastened is at a rest position and blocked, with couple of housings 41, 51 of first 4 and second 5 element aligned each other, and first 42, second 52 and third 62 housings aligned so as to house first prevent and release means 91 within first 42 and second 52 housings and second prevent and release means 92 within second 52 and third 62 housings, and elastic element 63 in a first position, i.e. in an extended position, wherein it normally maintains said prevent and release means 91, 92 in the described position. In this position, centering means 9 and prevent and release means 91, 92 prevent rotation of first 4 and second 5 element with respect to planes 7 and 8 (as shown in FIG. 3A), during said step, first hole 44 of first element and second hole 54 of second element 4 correspond, and are opposed at 180°, each other, with respect to the third locks hole 64 of the third element 6.

b. approaching actuation device 2 to the outer surface of device 3 to be fastened and unfastened, particularly relief 24 of actuation device 2 engages with first hole 44 on first element 4 and actuation elements 22 magnetically engage with centering means 9. Consequently, centering means 9 moves so as to align and permit free rotation of first element 4 with respect to plane 7 (as shown in FIG. 3B).

c. by rotation of actuation device 2 by grasping element 23 and dragging of relief 24 on first hole 44, rotation of first element 4 with respect to plane 7 is started.

Figure 3E:
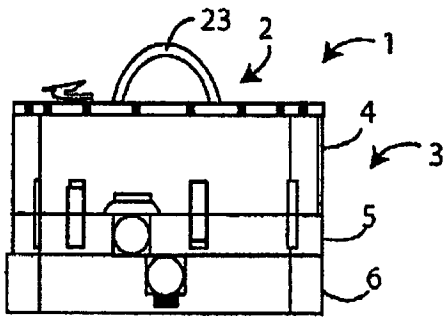
Figure 3D:
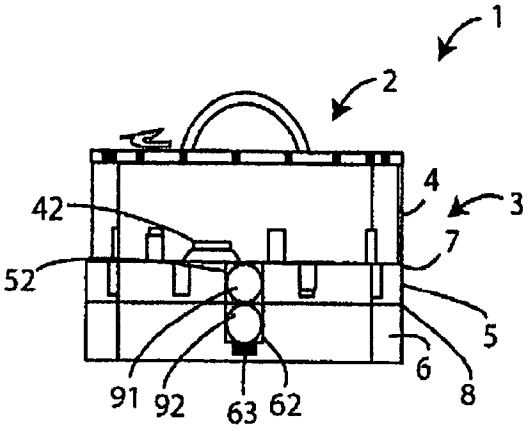
Figure 3C:
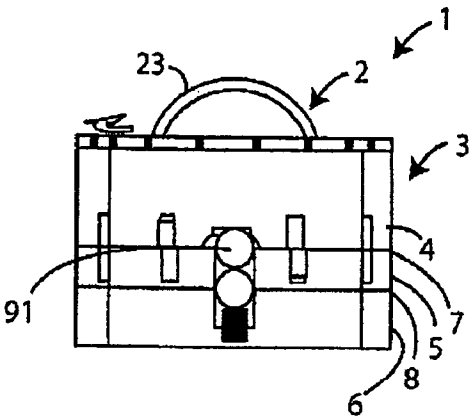

By rotating element 4 with respect to plane 7, first prevent and release means 91 is pushed toward second element 5 by slanted edges of first housing 42 (as shown in FIG. 3C), also pushing second prevent and release means 92, against the action of elastic element 63.

d. by continuing rotation of first element 4, first prevent and release means 91 completely enter within said second housing 52, and thus second prevent and release means 92 completely enters within third housing 62, also thanks to compression of elastic element 63 (as shown in FIG. 3D). e. following said step, prevent and release means 91, 92 release also second element 5, thus being able to freely rotate with respect to planes 7 and 8, and being brought back toward first element 4, so as to align with said first element 4, particularly by magnetic return action of centering means 9, thus going back (elements 4 and 5) to the start position.

In this way, first 4 and second 5 elements integrally prosecute rotation, thus unfastening device 3 to be unfastened (as shown in FIG. 3E).

By continuing rotation of actuation device 2, first 4 and second 5 elements prosecute rotation, first prevent and release means 91 still rotate integrally with first 4 and second 5 elements, until when said first prevent and release means 91 abuts against a slight abutment (not shown) on contact surface of third element 6, indicating a stop position.

In this position, it is possible removing actuation device 2, and first hole 44 and second hole 54 eventually permit uncovering third hole 64 of lock provided in third element 6.

Rotation can thus prosecute, even without using actuation device, until when three housings 42, 52, 62 are aligned again and first prevent and release means 91 is again in the start position, pushed by elastic element 93, and consequently by second prevent and release means 92, toward first element 4, thus preventing rotation of first 4 and second 5 elements, thus fastening the same.

A further prevent and release means 93, or peg, (shown in FIG. 2) can be provided in this embodiment between a further fourth housing (not shown) of the second element 5 and a guide 43 obtained in the lower part of first element 4. Said further prevent and release means 93 prevents that rotation movement of first 4 and second 5 element can still occur, preventing that housings of a first couple align, thus mixing with those of a second couple of housings.

Figure 4:
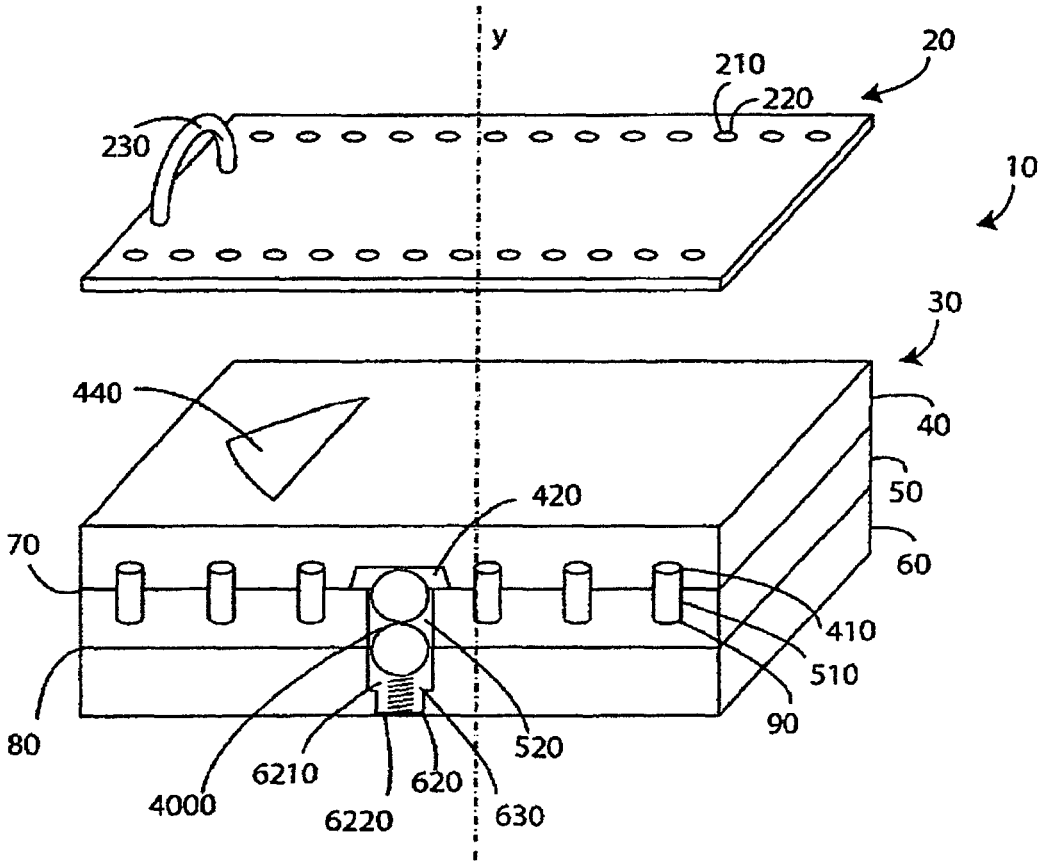
FIG. 4 is a perspective view of a second embodiment of the fastening and unfastening system according to the invention.
Figure 5:
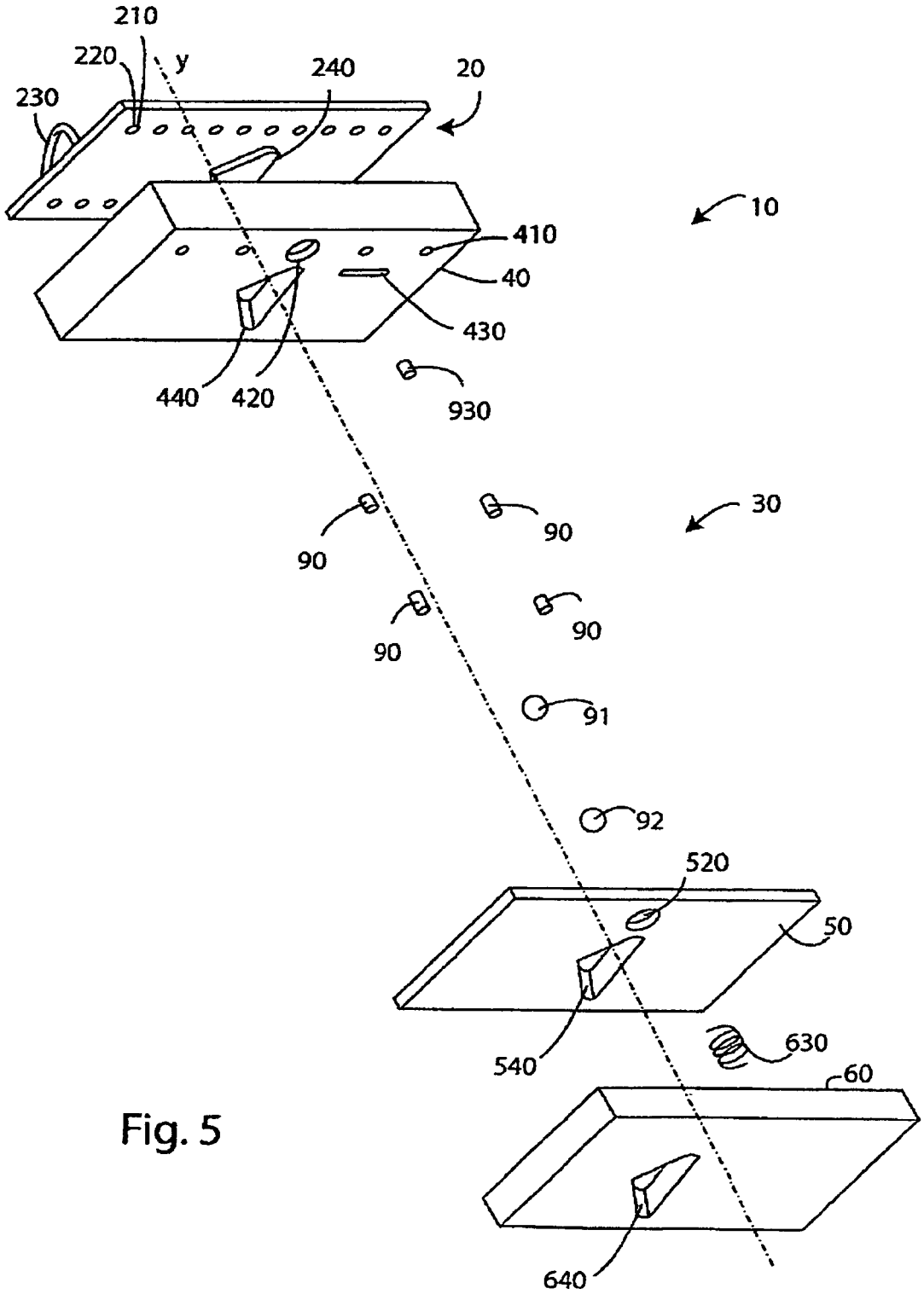
FIG. 5 is an exploded perspective view of the system of FIG. 4.

A second embodiment is shown in FIGS. 4 and 5, showing a fastening and unfastening system 10 according to the invention, having a parallelepiped shape able to make a linear movement.

Said system 10 provides an actuation device 20 and a device 30 to be fastened and unfastened.

Parallelepiped actuation device 20 has a plurality of cylindrical housings 210, all provided along long sides of parallelepiped, equidistant from central axis y of the same device. A cylindrical actuation element 220 is present within each housing 210. Said actuation elements 220 can be comprised of magnetic material, of magnetic-sensitive material or of magnetically inert material.

A grasping element 230 is provided on upper surface of actuation device 20, in this case a metallic hook, easing the use of the actuation device 20. Said grasping element 230 can be further rotated so as to close on the flat surface of the actuation device 20.

A relief 240 is obtained on the lower surface of the actuation device 20. Relief 240 has a triangular shape with rounded corners, but in other embodiments it can have a different geometrical shape.

Device 30 to be fastened and unfastened, having a parallelepiped shape having the same dimensions of actuation device 20, provides a first element 40, a second element 50 and a third element 60. A first relative plane 70 is provided between first element 40 and second 50 elements, and second relative plane 80 is provided between second element 50 and third 60 elements.

Second element 50 is linearly movable with respect to the first plane 70 and with respect to the second plane 80.

In the present embodiment, first element 40 too is movable with respect to first plane 70, while third element 60 is fixed.

In further embodiments (not shown), it is possible making first element 40 fixed with respect to first plane 70, and third element 60 movable with respect to second plane 80, always remaining within the scope of the invention, and obtaining the same technical effect.

First element 40 and second element 50 respectively have a first hole 440 and a second hole 540, said holes having substantially the same shape, dimension and position of the relief 240 of actuation device 20, in this case a triangle with rounded corners.

Third element 60 too has a third hole 640 for locks, substantially having the same shape and dimension of holes 440, 540 described in the above, but in a different position.

Furthermore, first element 40 and second element 50 provide a plurality of couples of cylindrical housing 410, 510, having the same shape and dimension each other, and in number equal to the plurality of actuation elements 220 provided on actuation device 20. A centering means 90 is provided within each couple of housings 410, 510. Housing couples 410, 510 are aligned with corresponding ends along plane 70.

In the embodiment shown, centering means 90 is comprised of a couple of cylindrical elements, made up of magnetic material or of magnetic-sensitive material or of magnetically inert material, two of them having the same section but different length. In further embodiments, it is possible having a higher number of cylindrical elements.

At least a housing 4000 is provided between said first 40, second 50 and third 60 elements. More particularly, said housing 4000 is comprised of corrispondence between a first housing 420 of first element 40 and a second housing 520 of second element 50 and a third housing 620 of third element 60. First housing 420 of first element 40 has a substantially trapezoidal section, with rounded corners and with long side faced toward said second element 50, while second housing 520 of second element 50 is obtained all along the volume, having a tridimensional hollow shape with dimensions reduced with respect to the first housing 420, and third housing 620 of third element 60 has a first portion 6210, in correspondence of second plane 80, having a hollow cylindrical shape and a second lower portion 6220, having a slightly reduced cylindrical shape, with upper part open in correspondence of the first portion 6210. An elastic element 630, particularly a spring, is housed within second portion 6220 of third housing 620.

A first 910 and a second 920 prevent and release means are provided within housing 4000, in this case having a spherical shape and base diameter substantially equal to the diameter of the second housing 520, with said first prevent and release means 910 provided above the second prevent and release means 920. Dimensions of the first further housing 420 are such to prevent an immediate and direct contact with surface of first prevent and release means 910. Said prevent and release means 910, 920 prevent, when at rest, movement of first 40 and second 50 elements with respect to planes 70 and 80.

Making reference to FIGS. 6A, 6B, 6C, 6D and 6E, it is observed operation of the second embodiment of fastening and unfastening system 10 according to the invention.

Figure 6B:
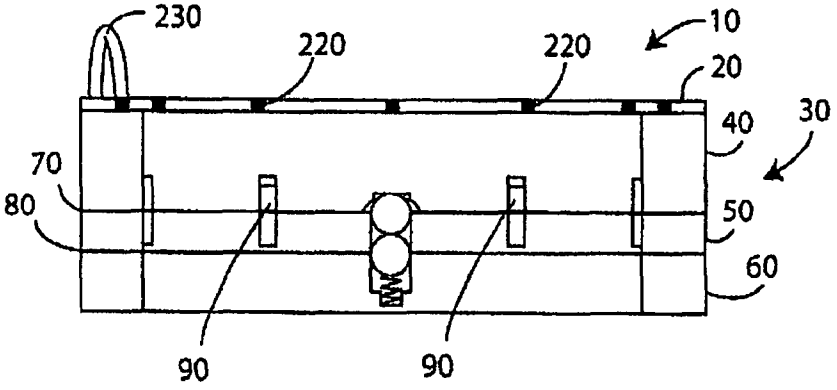
FIGS. 6A, 6B, 6C, 6D and 6E show section front views of the system of FIG. 4.
Figure 6A:
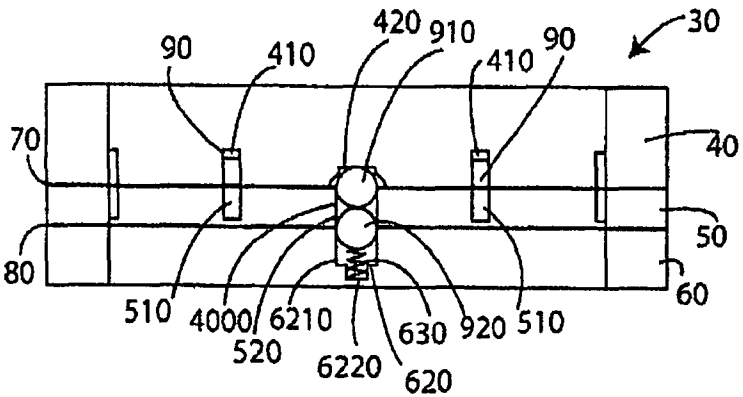

Fastening and unfastening phases of actuation device 20 with device 30 to be fastened or unfastened will be described in the following:

a. device 30 to be fastened or unfastened is at a rest position and blocked, with couple of housings 410, 510 of first 40 and second 50 element aligned each other, and first 420, second 520 and third 620 housings aligned so as to house first prevent and release means 910 within first 420 and second 520 housings and second prevent and release means 920 within second 520 and third 620 housings, and elastic element 630 in a first position, i.e. in an extended position, wherein it normally maintains said prevent and release means 910, 920 in the described position. In this position, centering means 90 and prevent and release means 910, 920 prevent movement of first element 40 and second element 50 with respect to planes 70 and 80 (as shown in FIG. 6A). During said step, first hole 440 of first element 40 and second hole 540 of second element 50 correspond to each other, and are in a different position, with respect to the third hole for locks 640 of the third element 60.

b. approaching of actuation device 2*o* to the outer surface of device 30 to be fastened and unfastened, particularly relief 240 of actuation device 20 engages with first hole 440 on first element 40 and actuation elements 220 magnetically engage with centering means 90. Consequently, centering means 90 move so as to align and permit free movement of first element 40 with respect to plane 70 (as shown in FIG. 6B).

c. by movement of actuation device 20 by grasping element 230 and dragging of relief 240 on first hole 440, linear movement of first element 40 with respect to plane 70 is started.

Figure 6D:
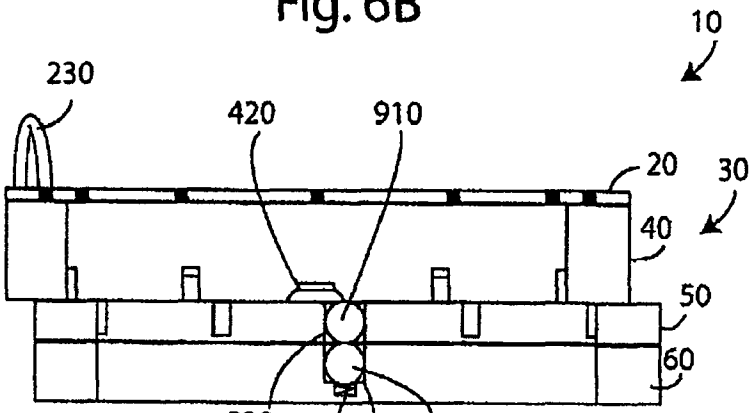
Figure 6C:
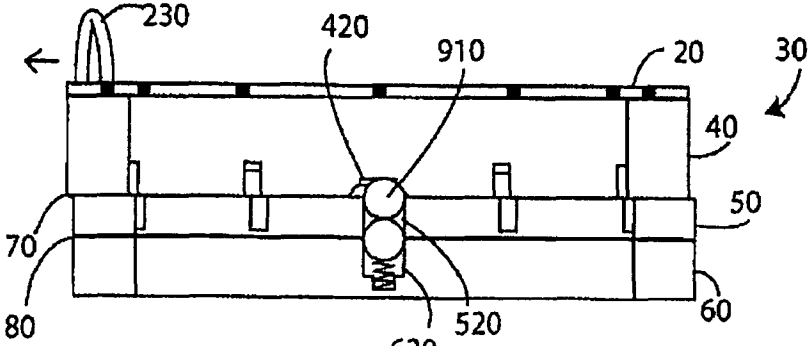
Figure 6E:
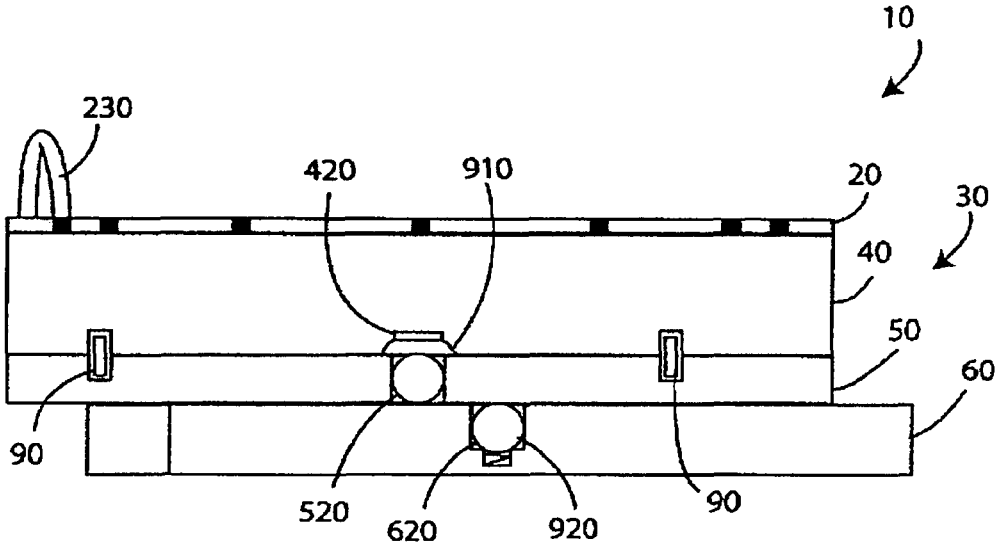

By moving element 40 with respect to plane 70, first prevent and release means 910 is pushed toward second element 50 by slanted edges of first housing 420 (as shown in FIG. 6C), also pushing second prevent and release means 920, against the action of elastic element 630.

d. by continuing linear movement of first element 40, first prevent and release means 910 completely enter within said second housing 520, and thus second prevent and release means 920 completely enters within third housing 620, also thanks to compression of elastic element 630 (as shown in FIG. 6D).

e. following said step, prevent and release means 910, 920 release also second element 50, thus being able to freely move with respect to planes 70 and 80, and being brought back toward first element 40, so as to align with said first element 40, particularly by magnetic return action of centering means 90, thus going back (elements 40 and 50) to the start position. In this way, first 40 and second 50 elements integrally prosecute movement, thus unfastening device 30 to be unfastened (as shown in FIG. 6E).

By continuing movement of actuation device 20. first 40 and second 50 elements prosecute the movement, first prevent and release means 910 still rotate integrally with first 40 and second 50 elements, until when said first prevent and release means 91 abuts against a slight abutment (not shown) on contact surface of third element 60, indicating a stop position. In this position, it is possible removing actuation device 20, eventually uncovering third hole 640 of lock provided in third element 60.

To return to the start position, it is necessary making a reverse movement, even without using the actuation device 20, until when three housings 420, 520, 620 are aligned again and first prevent and release means 910 is again in the start position, pushed by elastic element 630, and consequently by second prevent and release means 920, toward further first element 420, thus preventing movement of first 40 and second 50 elements, thus fastening the same.

A further prevent and release means 930, or peg, (shown in FIG. 5) can be provided in this embodiment between a further fourth housing (not shown) of the second element 50 and a guide 430 obtained in the lower part of first element 40. Said further prevent and release means 930 prevents that rotation movement of first 40 and second 50 element can still occur, preventing that housings of a first couple align, thus mixing with those of a second couple of housings.

Figure 7:
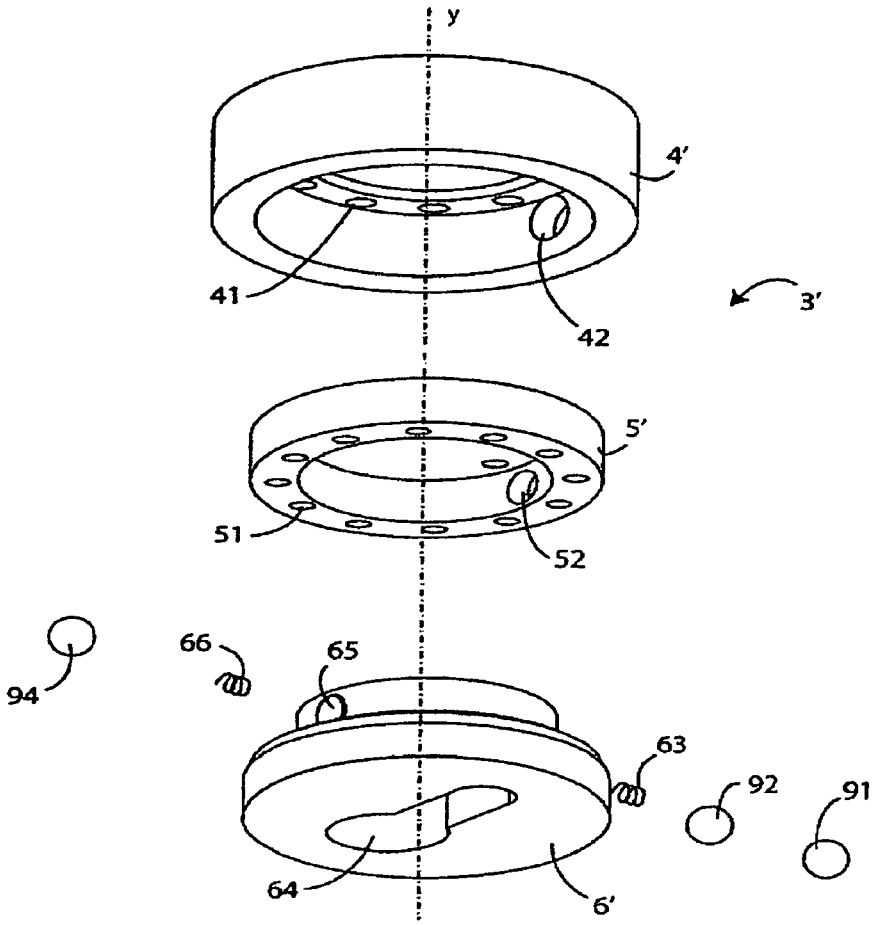
FIG. 7 is a perspective view of a third embodiment of the fastening and unfastening system according to the invention.
Figure 8:
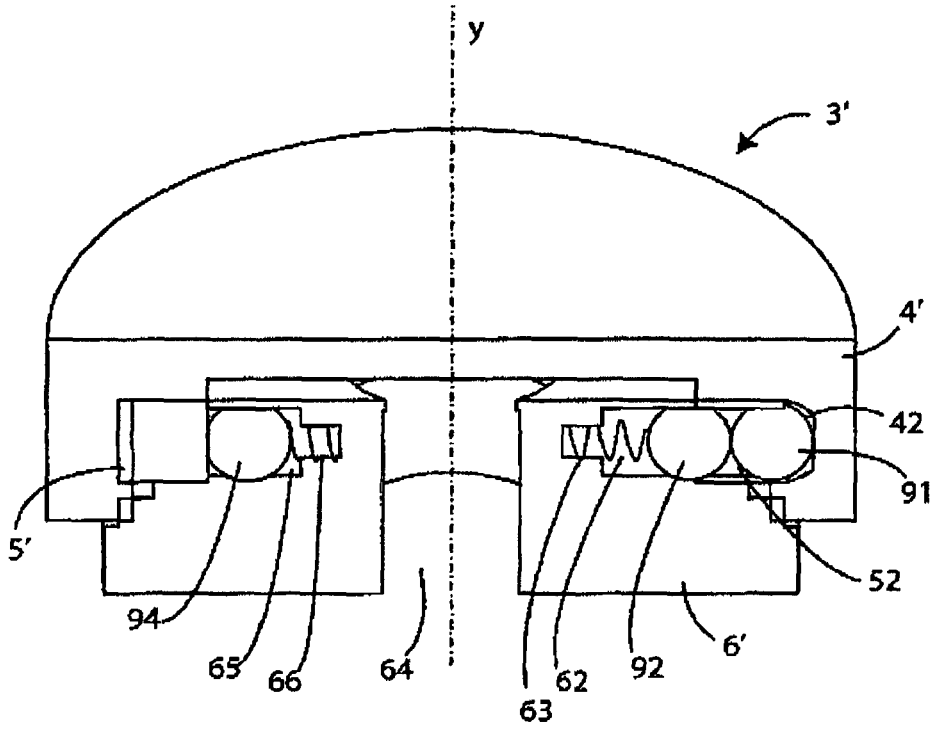
FIG. 8 is a section perspective view of the system of FIG. 7.

Finally, making reference to FIGS. 7 and 8, it is possible observing a third embodiment of the invention, said embodiment being similar to those described with reference to FIG. 1-6, and therefore the same reference numbers have been used to indicate the same parts.

In the third embodiment, device 3' to be fastened or unfastened provides three concentric elements, i.e. a first element 4', a second element 5' and a third element 6'. A housing is provided in this embodiment, realized perpendicular with respect to the central axis y of the device 3' to be fastened or unfastened. Said housing is obtained in correspondence of a first further housing 42, obtained in first element 4', a second further housing 52, obtained in second element 5', and a third further housing 62, obtained in third element 6'.

A first prevent and release means 91, provided within said first further housing 42 and said second further housing 52, a second prevent and release means 92, provided between said second further housing 52 and said third further housing 62, and a pushing means 63, particularly a spring, provided within said third further housing 62, are all provided within said housing.

Furthermore, a further fifth housing can be provided in said third element 6', as shown in the figures, on the opposite side with respect to the further third housing 62 wherein a further pushing element 66 and a third prevent and release means 94 are provided. The above configuration makes it necessary the use of an actuation element to prosecute the rotation.

Preferred embodiments of the present invention have been described for illustrative, but not limitative purposes, but it is to be understood that variations and modifications can be introduced by those skilled in the art without departing from the scope of the invention as defined in the enclosed claims.

The invention claimed is:

1. A fastening or unfastening system (1, 10) including: an actuating device (2, 20), which has a plurality of actuating elements (22, 220) made of magnetic, magneto-sensitive or magnetically inert material; and a device to unlock or lock (3, 30, 3'), which includes a first element (4, 40, 4'), a second element (5, 50, 5') and a first plane (7, 70), between said first element (4, 40, 4') and said second element (5, 50); said first element (40, 4, 4') and said second element (5, 50, 5') presenting a plurality of housing couples (41, 51, 410, 510) corresponding to said plurality of actuating elements (22, 220) of said actuating device (2, 20); said plurality of housing couples (41, 51, 410, 510) being aligned with the ends matching along said first plane (7, 70); in each of said housing couples (41, 51, 410, 510) centering means (9, 90) are provided, able to lock or unlock the movement in respect to said first plane (7, 70) of said first element (4, 40, 4') and said second clement (5, 50, 5'); said centering means (9, 90) being made of magnetic, magneto-sensitive or magnetically inert material; wherein said device to lock or unlock (3,30, 3') in said system (1, 10) further includes at least one third element (6, 60, 6') and a second plane (8, 80), between said second element (5, 50, 5') and said third element (6, 60, 6'); and in that said first element (4, 40, 4') has a first further housing (42, 420), said second element (5, 50, 5') has a second further housing (52, 520) and said third element (6, 60, 6') has a third further housing (62, 620), said first (42, 420), second (52, 520) and third (62, 620) further housings being aligned with the ends matching, in order to form a single housing (400, 4000), and in that said single housing (400, 4000) provides, internally, at least two prevent and release means (91, 92, 910, 920) each sliding mutually, and a thrust element (63, 630) acting on said prevent and release means (91, 92, 910, 920), and in that said system (1, 10) can take a first configuration, wherein said prevent and release means (91, 92, 910, 920), block the movement of said first, second and third elements (4, 40, 4', 5, 50, 5', 6, 60, 6') in respect to said first and second planes (7, 70, 8, 80), and a second configuration wherein said prevent and release means (91, 92, 910, 920) and said thrust element (63, 630), in a compressed form, allow movement of said first (4, 40, 4') and second (5, 50, 5') element in respect to said first and second planes (7, 70, 8, 80), and in that coupling and movement of said actuating device (2, 20) allows movement from said first to said second configuration.

2. The system (1, 10) according to claim 1, wherein said prevent and release means (91, 92, 910, 920) include a first prevent and release means (91, 910) and a second prevent and release means (92, 920).

3. The system (1, 10) according to claim 2, wherein during said first configuration, said first prevent and release means (91, 910) is housed between said first further housing (42, 420) and said second further housing (52, 520) and said second prevent and release means (92, 920) is housed between said second further housing (52, 520) and said third further housing (62, 620).

4. The system (1, 10) according to claim 2, wherein during said second configuration, said first prevent and release means (91, 910) is housed entirely in said second further housing (52, 520) and said second prevent and release means (92, 920) is housed entirely in said third further housing (62, 620).

5. The system (1, 10) according to claim 2, wherein said first prevent and release means (91, 910) is a sphere.

6. The system (1, 10) according to claim 2, wherein said second prevent and release means (92, 920) is a sphere.

7. The system (1, 10) according to claim 1, wherein said first further housing (42, 420) has a substantially trapezoidal cross-section with rounded corners and having the long side toward said second element (5, 50, 5').

8. The system (1, 10) according to claim 1, wherein said second further housing (52, 520) has a cylindrical hollow shape.

9. The system (1, 10) according to claim 1, wherein said third further housing (62, 620) has a first portion (621, 6210), in correspondence to said second plane (8, 80), having a cylindrical hollow shape and a second portion (622, 6220), having a smaller diameter, with an open end in correspondence to said first portion (621, 6210).

10. The system (1, 10) according to claim 9, wherein said thrust element (63, 630) is housed in said second portion (622, 6220) of said third further housing (62, 620).

11. The system (1, 10) according to claim 1, wherein a recess is provided on the outer surface of said third element (6, 60, 6), so that said recess engages with said first prevent and release means (91, 92, 910, 920).

12. The system (1, 10) according to claim 1, wherein said system comprises a further prevent and release means (93, 930) inserted, in correspondence to said first plane (7, 70) between a fourth further housing obtained from said second element (5, 50, 5') and between a rail (43, 430) obtained on the surface of said first element (4, 40, 4'), or vice versa.

13. The system (1, 10) according to claim 1 wherein said first element (4, 40, 4') is movable and said third element (6, 60, 6') is fixed.

14. The system (1, 10) according to claim 13, wherein said actuating device (2, 20) has a relief (24, 240), and in that said first element (4, 40, 4') and said second element (5, 50, 5') have, respectively, a first hole (44, 440) and a second hole (54, 540), and that said relief (24, 240) of said actuating device (2, 20) engages with said first hole (44, 440) of said first element (4, 40, 4').

15. The system (l, 10) according to claim 13, wherein said third element (6, 60, 6') has a third hole (64, 640) for a lock, in a different position in respect to said first hole (44, 440) and said second hole (54, 540).

16. The system (1, 10) according to claim 1, wherein said first element (4, 40, 4') is fixed and said third element (6, 60, 6') is movable.

17. The system (1, 10) according to claim 16, wherein said actuating device (2, 20) has a relief (24, 240), and in that said third element (6, 60, 6') and said second element (5, 50, 5') have, respectively, a further third hole and a second hole (54, 540), and that said relief (24, 240) of said actuating device (2, 20) engages with said further third hole of said third element (6, 60, 6').

18. The system (1, 10) according to claim 16 wherein said first element (4, 40, 4') has a further first hole for a lock, in a different position in respect to said further third hole and said second hole (54, 540).

19. The system (1, 10) according to claim 1, wherein said single housing (400, 4000) is arranged in a horizontal position in respect to the central axis (y) of said device to lock or unlock (3, 30, 3').

20. The system (1, 10) according to claim 1, wherein said single housing (400, 4000) is placed in a vertical position in respect to the central axis (y) of said device to lock or unlock (3, 30, 3').

21. The system (1, 10) according to claim 1, wherein said third element (6, 60, 6') has at least a fifth further housing (65), arranged crosswise to the movement direction of said device to lock or unlock (3, 30, 3').

22. The system (1, 10) according to claim 21, wherein; each of said fifth further housing (65) includes a further thrust element (66) and a further second prevent and release means (94).

* * * * *